US005661941A

United States Patent [19]

Vataker

[11] Patent Number: 5,661,941

[45] Date of Patent: Sep. 2, 1997

[54] CONSTRUCTIONAL BUILDING SET

[75] Inventor: Synnøve Vataker, Søborg, Denmark

[73] Assignee: Interlego AG, Baar, Switzerland

[21] Appl. No.: 617,914

[22] PCT Filed: Sep. 21, 1994

[86] PCT No.: PCT/DK94/00357

§ 371 Date: Mar. 19, 1996

§ 102(e) Date: Mar. 19, 1996

[87] PCT Pub. No.: WO95/08378

PCT Pub. Date: Mar. 30, 1995

[30] Foreign Application Priority Data

Sep. 22, 1993 [DK] Denmark ..... 1068/93

[51] Int. Cl.[6] ..... A63H 33/06; A63H 33/08; E04C 1/00

[52] U.S. Cl. ..... 52/604; 52/578; 446/482; 446/128; 446/118; 446/108; 446/116; 446/124

[58] Field of Search ..... 52/578, 604, 592.6; 446/128, 124, 482, 118, 116, 120, 108

[56] References Cited

U.S. PATENT DOCUMENTS

| | | | |
|---|---|---|---|
| 294,607 | 3/1884 | Frost | 446/124 |
| 879,455 | 2/1908 | Frost | 446/128 X |
| 1,193,975 | 8/1916 | Beardsley | 446/118 X |
| 1,660,119 | 2/1928 | Decker | 446/482 X |
| 3,074,203 | 1/1963 | Paksy | 446/120 |
| 3,220,141 | 11/1965 | Goss | 446/124 |
| 4,744,780 | 5/1988 | Volpe | 446/128 |
| 4,919,635 | 4/1990 | Bertrand | 446/124 X |
| 5,061,218 | 10/1991 | Garage et al. | 52/593 X |
| 5,259,803 | 11/1993 | Lyman | 446/128 X |

FOREIGN PATENT DOCUMENTS

| | | | |
|---|---|---|---|
| 427698 | 5/1991 | European Pat. Off. . | |
| 0291780 | of 1931 | Italy | 446/482 |
| 0294560 | 8/1928 | United Kingdom | 446/482 |

*Primary Examiner*—Robert Canfield

*Attorney, Agent, or Firm*—Kane, Dalsimer, Sullivan, Kurucz, Levy, Eisele and Richard, LLP

[57] ABSTRACT

A building element for a constructional building set having coupling means for coupling to other building elements included in the building set by cooperation with their coupling studs arranged with mutual modular measures, said coupling means comprising flanges whose side faces are adapted to engage a plurality of the coupling studs on the other building element in a first number of orientations of the building element with respect to the other building element, said flanges being divided into sections so as to form edge faces which serve as engagement faces with the coupling studs in a second number of orientations of the building element.

10 Claims, 3 Drawing Sheets

CONSTRUCTIONAL BUILDING SET

The present invention concerns a building element for a constructional toy building set with coupling means for coupling the element to other building elements, which are included in the building set, through cooperation with their coupling studs arranged with mutual modular measures, said coupling means comprising flanges whose side faces are adapted to engage a plurality of the coupling studs on another building element in a first plurality of orientations of the building element with respect to the other building element.

Such building sets are known e.g. from U.S. Pat. Nos. 3,867,784, 5,061,218 and DK patent 120 627. These building sets thus comprise building elements which consist of substantially rectangular boxes, whose underside is open and whose upper side is provided with protruding studs. The studs are shaped so as to be insertable from below into another building element, such that at least some of the edge faces of the studs engage the side faces on the flanges which are formed by the side faces of the box-shaped building element.

Although it is ensured hereby that the building elements can be combined in many ways, it is, however, a drawback of such existing building sets that the embodiments of studs and flanges after all restrict the number of orientations in which a first building element can be positioned on another. Thus, a building element according to Danish patent DK 120 627 can be placed in four different orientations on another building element of the same type.

However, in many connections, e.g. where one of the building elements is shaped as a chair or another piece of furniture to be placed on another building element, e.g. a building plate which serves as a floor, it is desirable that the piece of furniture can be positioned with more orientations on the building plate than the number which is limited by the structure of the known building elements, always provided however that the new and the known building elements are compatible.

This can be achieved using a known chair building element for use in connection with the building elements of DK 120 627. Thus, this chair element is downwardly provided with flanges shaped such that, depending upon the position on another element, they either surround one of the studs of the other element, or protrude down between four of these studs. The flanges are shaped such that the chair element in the first-mentioned position has the greatest possible support face, while still being capable of rotating freely around the stud-of the other element. Although it is thus possible to rotate this element freely about a stud, the base face of the element is limited dimensionally by the distance between two studs opposed with respect to the surrounded stud, in order for this rotation to be possible.

The object of the invention is therefore to provide a building element of the type mentioned in the opening paragraph, which can be oriented in more ways on a building element of the known type than is possible solely using the known building elements, while the base face may be dimensioned larger than the base face of the known chair element so that the element is more difficult to overturn.

This is achieved with a building element as since the flanges are thus divided into sections in such a manner that edge faces are formed on the flanges, said edge faces serving as engagement faces with the coupling studs when the building element is oriented in another manner than is possible with the known building elements, it is clear that these flanges define a periphery for the base face of the building element which intersects the coupling studs in the above-mentioned orientation. Therefore, the size of the base face is not restricted by the spacing of the coupling studs, as is the case with the known chair element.

An embodiment of the invention for use in connection with building elements of DK 120 627 is preferred, in which the building element may be rotated approximately 45° with respect to the orientations which are possible with the known elements, so that the building element may be positioned in a total of 8 different orientations.

The element may additionally be displaced half a modular distance at an angle of 45° with respect to the modular direction, and with an orientation in one of the modular directions.

When the edge faces have a shape complementary with respect to the studs, wear in the use of the building element is reduced.

A frictional connection may be established, which makes unintentional separation of the elements difficult.

If the building element is provided with additional coupling means within the base face of the rectangle, these additional coupling means may support the building element, in particular in the situations where there is a great distance between the flange sections.

The additional coupling tubes may additionally serve as additional frictional couplings, which may be expedient, in particular in connection with large building elements.

The invention is particularly advantageous if the building element forms a piece of furniture or the like and the flanges serve as the legs of the piece of furniture. The reason is that the increased number of positions and orientations of the building element and thereby the piece of furniture increase the play value of the element, since it is of greater use in connection with the furnishing of e.g. a. doll's house, where the floor of the doll's house is formed by a building plate which is provided with coupling studs.

The building element itself may be provided with coupling studs.

Embodiments of the invention will be described below with reference to the drawing, in which FIG. 1 shows an element according to the invention in the form of a chair, seen obliquely from above.

Figure 1:
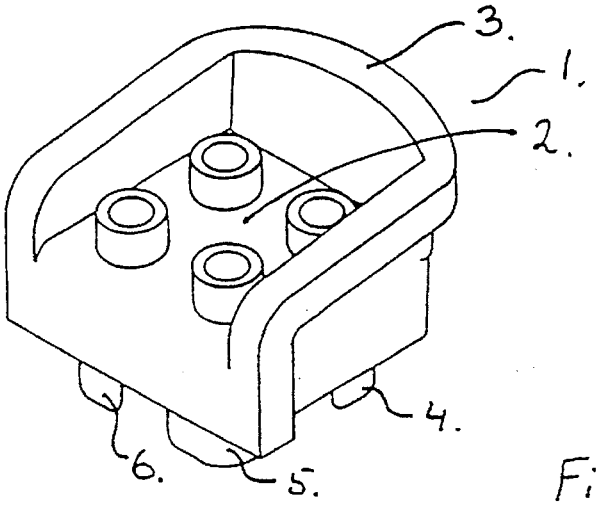
Figure 3:
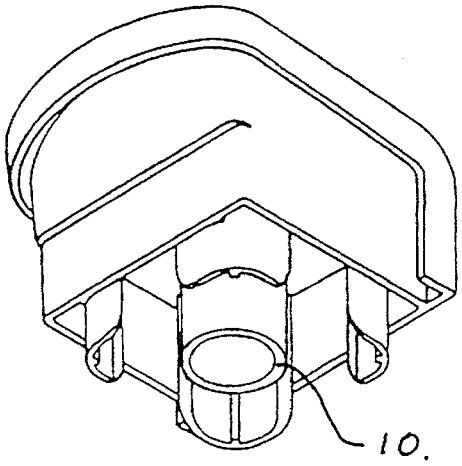
FIG. 3 shows an alternative embodiment of the element of FIG. 1 and FIG. 2, seen obliquely from below.
Figure 4:
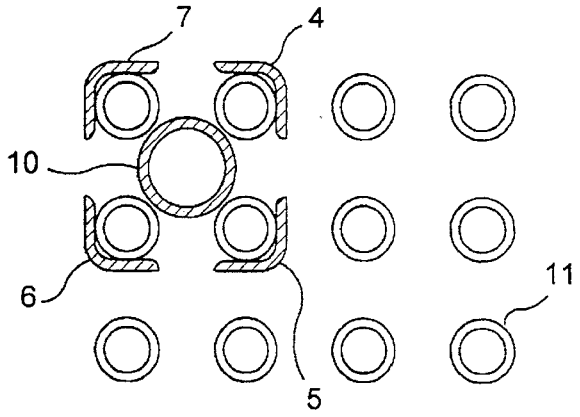

FIG. 4 schematically shows a location of the element of FIGS. 1 and 3 on a building plate having studs.

Figure 5:
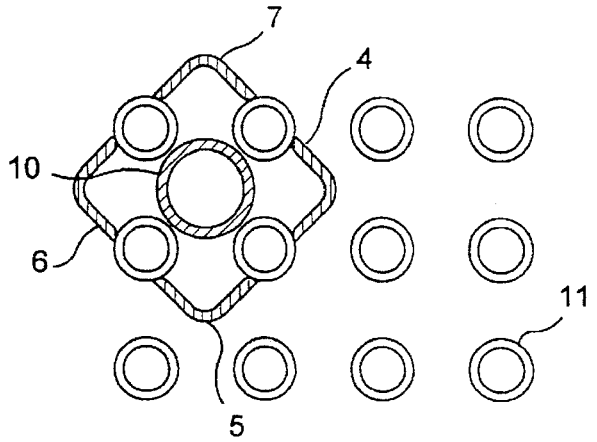

FIG. 5 schematically shows an alternative location of the element on the building plate.

Figure 6:
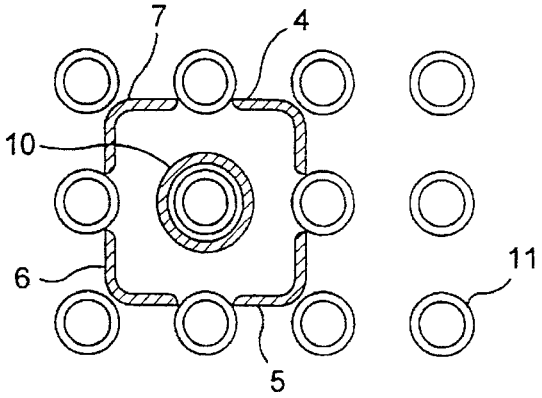

FIG. 6 schematically shows another alternative location of the element on the building plate.

Figure 7:
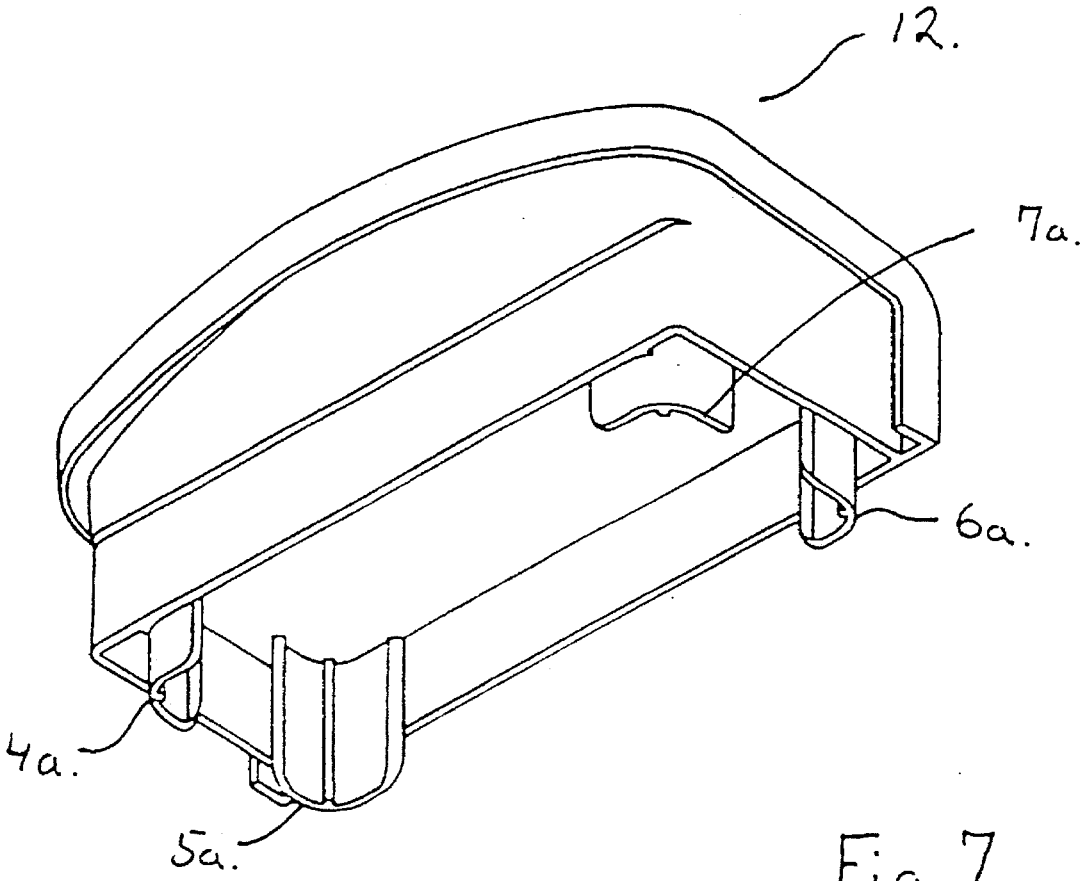

FIG. 7 shows an embodiment of the invention in the form of a sofa.

FIG. 1 thus shows an element 1 according to the invention in the form of a chair comprising a seat 2, a back 3 and four chair legs 4, 5, 6 and 7, of which just the chair legs 4, 5 and 6 are visible. The seat is here provided with coupling studs, so that a figure having coupling parts complementary with respect to the coupling studs may be placed on the chair.

Figure 2:
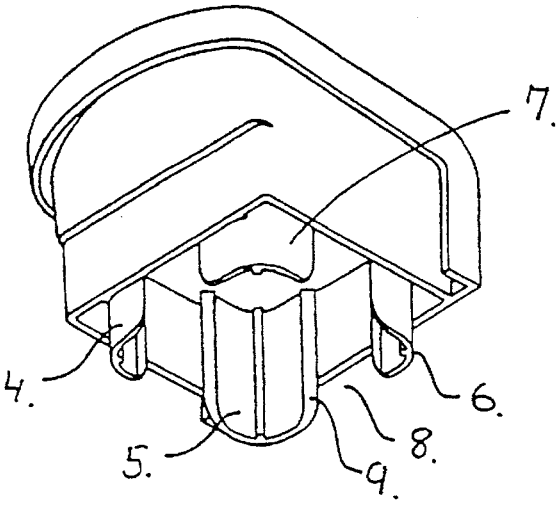
FIG. 2 shows the element of FIG. 1, seen obliquely from below.

FIG. 2 is a bottom view of the same chair and shows that the chair legs 4, 5, 6 and 7 are positioned in a square pattern. These chair legs 4, 5, 6 and 7 are shaped as flange sections which together define a box-shaped cross-section, and where gaps 8, at which the flange sections terminate in edge faces 9, are provided between the individual sections. These chair legs 4, 5, 6 and 7 are thereby adapted to serve as coupling means, so that the chair may be coupled frictionally to another element, such as e.g. a building plate which is provided with cylindrical coupling studs. This function will be described below in connection with FIGS. 4, 5 and 6.

The chair element may e.g. be provided with additional coupling means, as shown in FIG. 3, which shows the same chair element 1 as is shown in FIG. 1 and FIG. 2. In FIG. 3, the chair element is additionally provided with a cylindrical coupling tube 10. The cylindrical coupling tube is dimensioned so as to frictionally engage the coupling studs on a building plate, as will be described below in connection with FIGS. 4, 5 and 6.

FIGS. 4, 5 and 6 thus schematically show how the chair legs 4, 5, 6 and 7 on the chair element 1 of FIGS. 1, 2 and 3 may cooperate with coupling studs 11 on a building plate. The coupling studs 11 consist of cylindrical tubes 11 which protrude upwards from the surface of the building plate.

FIG. 4 thus shows that the chair legs 4, 5, 6 and 7 grip the coupling studs 11 on the building plate so that the coupling studs 11 engage the inner side of the flanges which are formed by the chair legs 4, 5, 6 and 7. This corresponds to the prior art in which ordinary box-shaped building elements have flanges engaging the coupling studs 11. As will be seen from FIG. 4, the division of the flanges into sections to form chair legs is actually not necessary for the element to be placed in this position.

If the chair element in FIG. 4 is of the type shown in FIG. 3, the cylindrical coupling tube 10 will engage the coupling studs 11 so that the coupling tube 10 touches four coupling studs 11 with its outer face.

FIG. 5 shows an alternative position of the chair element on a building plate which corresponds to the building plate of FIG. 4. The chair element is here rotated 45° with respect to the position shown in FIG. 4. The element is retained here in that the coupling studs 11 are received and retained by the edge faces 9 of the chair legs 4, 5, 6 and 7. According to the invention, this position is permitted solely because the flanges formed by the chair legs are divided into section.

If the chair element in FIG. 5 is of the type shown in FIG. 3, the coupling tube 10, like in FIG. 4, will engage four coupling studs 11 with its outer face.

It additionally appears from FIG. 5 how the chair element 1 may be placed in a third manner on the building plate, the chair element having the same orientation here as is shown in FIG. 4, but offset half a modular measure in a direction forming an angle of 45° with respect to the directions which are indicated by the rows of coupling studs 11. In this situation the edge faces 9 of the chair legs 4, 5, 6 and 7 engage coupling studs 11, arranged diagonally with respect to each other, and thus receive and retain these.

The flanges of the chair legs 4, 5, 6 and 7 may here be shaped so that the outer side engages additional coupling studs 11, which contributes to the frictional retention of the element on the building plate.

If the chair element in FIG. 6 is of the type shown in FIG. 3, the coupling tube 10 will surround one of the coupling studs 11.

FIG. 7 shows another embodiment of the invention, viz. a sofa 12 having sofa legs 4*a*, 5*a*, 6*a* and 7*a* which functionally correspond to the chair legs 4, 5, 6 and 7 on the chair element 1 of FIGS. 1, 2 and 3. As illustrated by this element, the idea of the invention is also useful in connection with elements which have an extent that is greater than the element shown in FIGS. 1, 2 and 3.

It is clear that the embodiments described above do not restrict the applicability of the invention. Thus, the number of legs or flanges formed by these may be varied depending upon the purpose. In addition, the basic principle, providing a large number of different possible positions, may be applied in connection with other types of elements than the furniture elements shown, such as ordinary modular building blocks and figures, such as animals and the like.

I claim:

1. A constructional building set comprising a first building element having coupling means for coupling to at least one other building element included in the building set by cooperation with coupling studs arranged in a pattern on the other building element, the pattern being defined by a number of modular directions and a mutual modular distance between closest neighboring studs, said coupling means comprising flanges whose side faces are adapted to engage a plurality of the coupling studs on the other building element in a first number of orientations of the first building element with respect to the other building element, the first number of orientations being parallel to the modular directions, and wherein the flanges are divided into sections so as to form edge faces which serve as engagement faces with the coupling studs in a second number of orientations of the building element, the second number of orientations being different from the first number of orientations.

2. A constructional building set according to claim 1, wherein the coupling studs on the other building element comprises cylindrical studs (11) arranged in a square pattern, wherein the flanges (4, 5, 6, 7) are placed in a pattern which forms a rectangle and that the sections comprise the corners of the rectangle so that, when the sides of the rectangle are parallel with the modular directions, the inner side of each corner engages one of the studs (11) and, in an orientation of approximately 45° with respect to the modular directions, engages one or two studs (11) with its edge faces (9).

3. A constructional building set according to claim 2, characterized in that the mutual distance between two parallel flanges (4, 5, 6, 7) in the rectangle has a size with respect to the modular distance such that the edge faces (9) engage one or two of the studs (11) when the sides of the rectangle or the square are parallel with the modular directions and when the rectangle is offset half a modular distance in each modular direction.

4. A constructional building set according to claim 1, 2 or 3 characterized in that the edge faces (9) have a shape complementary with respect to the studs so as to engage the sides of the studs (11) face to face.

5. A constructional building set according to claim 1, 2 or 3 characterized that at least in some of the possible positions on the other building element the flanges (4, 5, 6, 7) engage the studs (11) with such a force as provides a frictional connection.

6. A constructional building set according to claims 1, 2 or 3 characterized in that additional coupling means (10) are provided within the base face of the rectangle or the square.

7. A constructional building set according to claim 6, characterized in that the additional coupling means (10) comprise coupling tubes (10) having an outside diameter which is smaller than or equal to the distance between two studs (11) placed diagonally with respect to the modular directions, and an inside diameter which is greater than or equal to the diameter of the studs (11), and are positioned such that each of them, in a first number of possible positions of the building element on the other building element, extends down between four adjacent studs (11), and, in a second number of possible positions, surround a stud (11).

8. A constructional building set according to claim 7, characterized in that the coupling tubes (10) are adapted to engage the studs (11) frictionally.

9. A constructional building set according to claims 1, 2 or 3 characterized in that the element (1, 12) is shaped as a piece of furniture, and that the flanges (4, 5, 6, 7 ) serve as the legs of said piece of furniture.

10. A constructional building set according to claims 1, 2 or 3 characterized in that the element (1, 12) is provided with coupling studs at least on the side which faces away from the coupling means.

* * * * *